US010881581B2

(12) United States Patent
Koike et al.

(10) Patent No.: US 10,881,581 B2
(45) Date of Patent: Jan. 5, 2021

(54) MEDICATION SACHET PACKAGING DEVICE

(71) Applicant: Yuyama Mfg. Co., Ltd., Osaka (JP)

(72) Inventors: Naoki Koike, Osaka (JP); Ryosuke Fukamori, Osaka (JP)

(73) Assignee: YUYAMA MFG. CO., LTD., Toyonaka (JP)

( * ) Notice: Subject to any disclaimer, the term of this patent is extended or adjusted under 35 U.S.C. 154(b) by 193 days.

(21) Appl. No.: 16/323,501

(22) PCT Filed: Aug. 1, 2017

(86) PCT No.: PCT/JP2017/027883

§ 371 (c)(1),
(2) Date: Feb. 5, 2019

(87) PCT Pub. No.: WO2018/025852

PCT Pub. Date: Feb. 8, 2018

(65) Prior Publication Data

US 2019/0201284 A1 Jul. 4, 2019

(30) Foreign Application Priority Data

Aug. 5, 2016 (JP) ..... 2016-154173

(51) Int. Cl.
*A61J 1/03* (2006.01)
*A61J 7/00* (2006.01)
(Continued)

(52) U.S. Cl.
CPC . *A61J 1/03* (2013.01); *A61J 3/00* (2013.01); *A61J 7/0076* (2013.01); *A61J 7/02* (2013.01);
(Continued)

(58) Field of Classification Search
None
See application file for complete search history.

(56) References Cited

U.S. PATENT DOCUMENTS

2004/0112909 A1* 6/2004 Yamamoto ..... B65B 5/103 221/7
2012/0216485 A1 8/2012 Amano et al.
(Continued)

FOREIGN PATENT DOCUMENTS

CN 102802588 A 11/2012
CN 104066415 A 9/2014
(Continued)

OTHER PUBLICATIONS

Chinese Office Action dated Jul. 29, 2020 in Chinese Application No. 201780033745.X, Total 19 pages with translation.
(Continued)

*Primary Examiner* — Hemant Desai
*Assistant Examiner* — Tanzim Imam
(74) *Attorney, Agent, or Firm* — Masuvalley & Partners

(57) ABSTRACT

A medicine dispensing apparatus comprises a medicine containing/dispensing unit (11) for supplying medicines of various kinds; a medicine wrapping part (45) for wrapping the medicine supplied from the medicine containing/dispensing unit (11) for every one dose package by a dispensing paper (S); a medicine wrapping hopper (73) for falling down the medicine for one dose package into a dispensing paper S in the medicine wrapping part (45) and a medicine check part (5) for determining depending on a photographed image of the medicine wrapping hopper (73) whether or not the medicine is adheres to the introduction part.

15 Claims, 12 Drawing Sheets

(51) Int. Cl.

| | |
|---|---|
| ***A61J 7/02*** | (2006.01) |
| ***B65B 5/10*** | (2006.01) |
| ***B65B 57/10*** | (2006.01) |
| ***A61J 3/00*** | (2006.01) |
| ***B65B 1/30*** | (2006.01) |

(52) U.S. Cl.
CPC ..... *B65B 1/30* (2013.01); *B65B 5/103* (2013.01); *B65B 57/10* (2013.01)

(56) References Cited

U.S. PATENT DOCUMENTS

| | | | | |
|---|---|---|---|---|
| 2014/0318078 | A1* | 10/2014 | Kondo | B65B 5/103 53/54 |
| 2015/0129603 | A1* | 5/2015 | Koike | B65B 59/001 221/13 |
| 2016/0104282 | A1 | 4/2016 | Takahashi | |

FOREIGN PATENT DOCUMENTS

| | | | | |
|---|---|---|---|---|
| CN | 105338945 | A | 2/2016 | |
| JP | 4034404 | B2 | 1/2008 | |
| JP | 2011-104077 | A | 6/2011 | |
| JP | 2015-002795 | A | 1/2015 | |
| KR | 2014-0057945 | A | 5/2014 | |
| WO | WO2013/105198 | A1 | 7/2013 | |
| WO | WO-2015136598 | A1 * | 9/2015 | B65B 51/16 |
| WO | WO2016/047569 | A1 | 3/2016 | |

OTHER PUBLICATIONS

WIPO, Japan International Search Authority, International Search Report and Written Opinion dated Oct. 24, 2017 in International Patent Application No. PCT/JP2017/027883, 20 pages.
European Search Report dated Jan. 10, 2020, issued in European Application No. 17836955.9, 7 pages.

* cited by examiner

MEDICATION SACHET PACKAGING DEVICE

RELATED APPLICATIONS

This application is the U.S. National Phase of and claims priority to International Patent Application No. PCT/JP2017/027883, International Filing Date Aug. 1, 2017, entitled Medication Sachet Packaging Device; which claims priority to Japanese Application No. 2016-154173 filed Aug. 5, 2016; both of which are incorporated herein by reference in their entireties.

FIELD OF INVENTION

The present invention relates to a medicine dispensing apparatus for wrapping medicines such as tablets or capsules for every one dose package with a dispensing paper.

BACKGROUND ART

In Patent Literature 1, a tablet dispensing apparatus is disclosed and the apparatus comprises a plurality of tablet feeders containing various types of medicines, a tablet collecting mechanism for collecting by receiving the tablets discharged from these tablet feeders, and a packaging apparatus positioned to a tablet charging part at a tablet charging location from the tablet collecting mechanism and the apparatus also comprises a tablet identifying apparatus performing identifying processing of the tablets before the packaging thereof, a switching mechanism interposed between the tablet collecting mechanism and the tablet charging part and being capable of adopting selectively any state of the state for direct charging upon charging the tablets from the tablet collecting mechanism to the tablet charging part and the state for indirect charging via. the tablet identification apparatus, a control means comprising means for subjecting one part of tablets to the processing of the tablet identification apparatus for every prescription unit and for selectively omitting the residual part thereof from the processing by the tablet identification apparatus, the control means omitting selectively the processing of by the tablet identification apparatus with controlling the states of the switching mechanism, and a count judgement apparatus for taking a photograph of images used for a counting processing to the tablets after the packaging thereof.

PRIOR ART LITERATURE

Patent Literature

PATENT LITERATURE 1: Japanese Patent No. 4034404

SUMMARY OF INVENTION

Problem to be Solved by Invention

The above conventional medicine dispensing apparatus, as described above, performs photographing of the images used for counting processing about medicines after the packaging thereof. However, the medicines may overlap in a dispensing paper and may also contact with each other, and in such cases, there is a problem that number of the medicines may not be counted accurately based on the photographed images.

On the other hand, if the photographing is performed before the packaging thereof, there is possibility that photographed medicines may adhere to an introduction member for guiding the photographed medicines into a dispensing paper such that there are fears for preparing one dose package including the number of medicines different from the counted number.

The present invention provides, considering the above circumstances, a medicine dispensing apparatus for judging whether or not the photographed medicine taken before the dispensation adheres to an introduction member.

Means for Solving Problem

For solving the above problem, a medicine dispensing apparatus of the present invention may comprises a medicine supply part for supplying medicines of various kinds; a medicine wrapping part for wrapping the medicine supplied from the medicine supply part for every one dose package by a dispensing paper; an introduction member for introducing the medicine for one dose package into the dispensing paper in the medicine wrapping part; and a medicine check part for determining depending on a photographed image of the introduction part whether or not the medicine is adheres to the introduction part.

According to the above construction, since it is determined whether or not the medicine adheres to the introduction part from which the medicine for one dose package is made to fall into the dispensing paper in the medicine wrapping part, the possibility that the medicine supplied from the medicine supply part is not actually wrapped may be determined.

The medicine check part may comprise an introduction member photographing part for photographing the introduction member and a determination part for determining the adhesion of the medicine in the introduction member based on comparison between the image photographed by the introduction part photographing part and a basic image photographed under a condition that the medicine does not adhere to the introduction member.

The medicine check part may comprise a medicine number check part used for counting number of medicines for one dose package at an upper stream side of the introduction member.

The medicine number check part may receive the medicine for one dose package and photographs the medicine before the medicines for one dose package are introduced into the dispensing paper in the medicine wrapping part by the introduction member. Also, the image to be photographed may be a shaded image of the medicine by the light projected to the medicine received by the medicine number check part. Thereby, the number of medicines may be counted based on the shaded images of the medicines such that it becomes hard to suffer effects of a medicine color and a transparency and a counting accuracy may be improved.

The medicine number check part may comprise a medicine receiving plate part having a plurality of bottomless openings along to a same circumference about a rotation axis, a medicine receiving bottom part functioning as a bottom of the bottomless opening part and having a wrapping opening for supplying the medicine in the bottomless opening part into the introduction part at a particular position that the bottomless opening part is located with respect to a rotation of the medicine receiving plate part, and the bottomless opening part is supplied with the medicine from the medicine supply part. Thereby, it is possible to make a height of the medicine checking part as low as possible.

By rotating normally and reversely the medicine receiving plate part to cancel overlap of the medicines in the bottomless opening. Thereby, erroneous counting due to the overlap of the medicines may be reduced.

A lateral face of a position at a far side from a rotation axis of the medicine receiving plate part has an inclined shape slanting apart from the rotational axis as going to an upper side. Thereby, the state, in which the upper medicine ride above is positioned at the outer side (centrifugal side) with respect to the center of the medicine positioned lower, may be easily provided such that the overlap of the medicines may become easily cancelled. Here, the inclination of the lateral wall face may include not only a linear inclination but also a stepwise inclination or a curved inclination.

Among lateral wall faces of each bottomless opening part, at least lateral wall face at a position of a far side from a rotation axis of the medicine receiving plate part is formed continuously to have an angle between a plurality of angled edge parts. Thereby, for example, when the rotation of the medicine receiving plate part is stopped, the inertial movement of the medicines overlapped up-and-low and contacting the lateral wall face becomes hard to be a simple movement to the rotational direction of the medicine receiving plate part, which tends to occur in the case that the lateral face has a simple circular arc and the like, the overlap of the medicines may become easy to be cancelled.

In the construction that the lateral wall face has the plurality of edge parts, one of joint positions between the adjacent edges is positioned farthest from the rotation axis. Thereby, for example, when the rotation of the medicine receiving plate part is stopped, the medicines overlapped up-and-down while contacting with the lateral wall face may move inertially from the joint position of the edge parts (corner part) as a start point with receiving force toward the centripetal side rather than the rotational direction of the medicine receiving plate part such that the simple movement to the rotational direction is hardly provided and then the overlap of the medicine becomes easy to be cancelled.

The medicine receiving plate part may be made to rotate normally and reversely if number of medicines counted by using the medicine number check part is different from the number to be present. Thereby, fears of erroneous counting with the overlap of the medicines being not cancelled may be reduced.

The medicine receiving bottom part may have a light passing part at the other particular position that the bottomless opening part is located with respect to a rotation of the medicine receiving plate part, and the medicine number checking part comprises a lighting part for projecting lighting light to the light passing part from a lower side of the light passing part of the medicine receiving bottom part and a photographing part for counting that guides the light projected from the lighting part and passed to an upper side through the light passing part toward an imaging element. Thereby, the shaded image of the medicine may be photographed properly.

The photographing part for counting may comprise a reflection member positioned such that a reflection face is inclined at an upper position of the light passing part of the medicine receiving bottom part, and the imaging element is positioned to receive the light reflected by the reflection face of the reflection member and propagated to a direction almost parallel to an upper face of the medicine receiving plate part at a position outside the medicine receiving plate part. Thereby, a height of the photographing part above the medicine receiving plate part may become low and using the lens with an imaging angle as narrow as possible the shaded images of the medicines may be photographed precisely.

The reflection member is positioned such that an elevation angle of the reflection face becomes not more than 45 degrees. Thereby, the height of the photographing part above the medicine receiving plate part may be further reduced.

A shape of a lower ends of each bottomless opening part in the medicine receiving part and a shape of an upper end of the introduction member of the medicine receiving bottom part is the same with each other. Thereby, loss of the medicine may become harder upon making the medicine fall down to the introduction member from the bottomless opening part and also, partial blocking of the lighting light for projecting the introduction member between the bottomless opening part and the introduction member may be decreased.

The medicine check part may comprise a seal photographing part for photographing a wrapping seal part in the medicine wrapping part from an upper side of the introduction part. Thereby, the fact that the medicine was not wrapped adequately is judged from the image so that the possibility that the medicine supplied from the medicine supply part is not actually wrapped may be determined.

Advantage of Invention

In the present invention, an advantage for making it possible to judge the possibility that the medicine supplied from a medicine supply part is not actually packaged may be provided.

BRIEF DESCRIPTION OF DRAWINGS

FIG. 7 A perspective view of FIG. 6 with omitting a medicine wrapping hopper and the like.

FIG. 9 A plane view of a rotation plate shown in FIG. 8 and a medicine wrapping hopper and the like.

MODE FOR PRACTICING INVENTION

Figure 1:
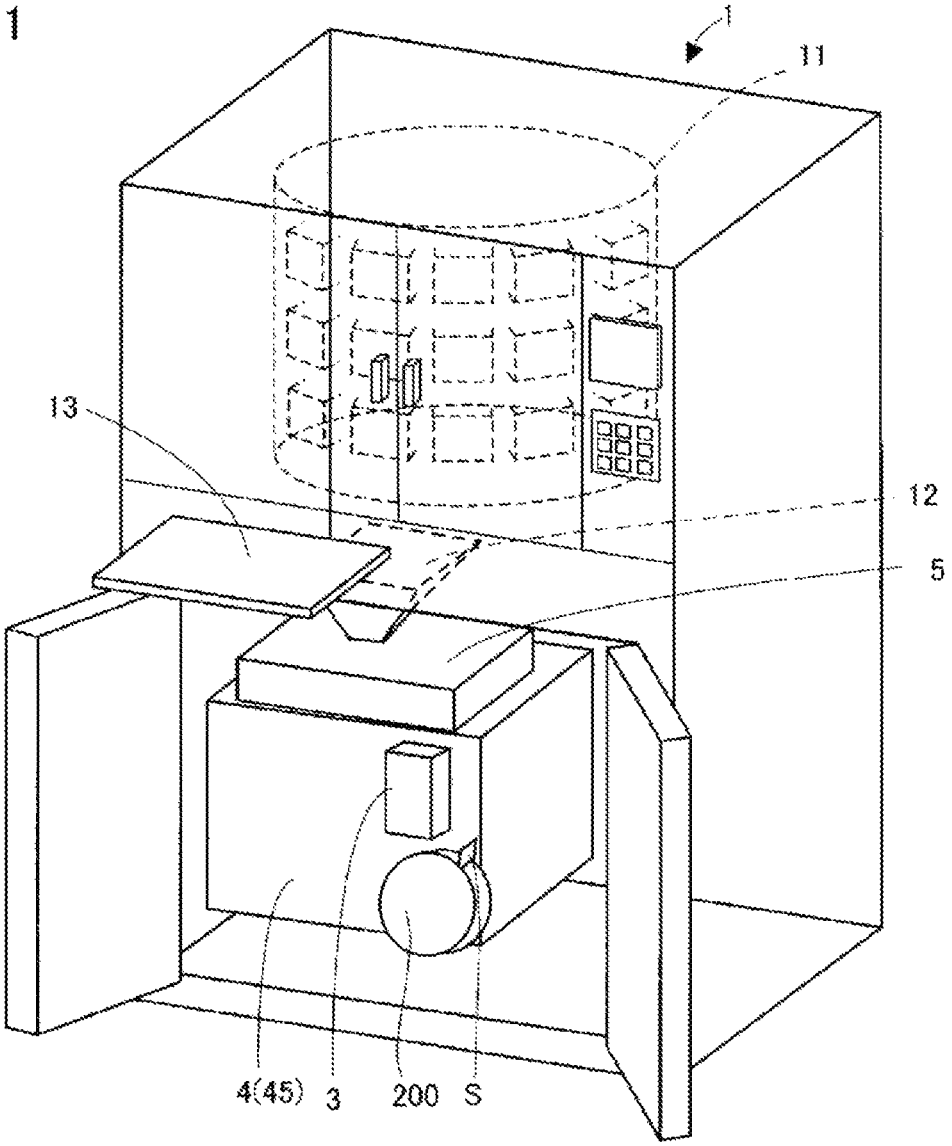
FIG. 1 An explanatory diagram of a medicine dispensing apparatus according to one embodiment of the present invention.

Hereunder, embodiments of the present invention will be described depending on attached drawings. As shown in FIG. 1, to a medicine dispensing apparatus 1 in this embodiment, a medicine containing/dispensing unit 11 as a medicine supply part for containing medicines for each kind and dispensing the medicine for ever one dose package depending on prescription data, a hopper 12 for receiving the medicine, a medicine check part 5 for checking the medicines dispensed for every one dose package, and a wrapping unit 4 equipped with a dispensing paper roll 200 and an ink ribbon cassette 3 and for performing print on a dispensing paper S and then wrapping the medicine passed through the medicine check part 5 with the dispensing paper S for every one dose package. The medicine dispensing apparatus 1 is also disposed with a hand distribution part 13. In the hand distribution part 13, measures are disposed as a lattice state and a user may charge the medicines for one dose package to each measure. For example, when morning, noon, and evening are prescribed for one day, the medicines are charged in three measures. To the medicine containing/dispensing unit 11, a plurality of medicine cassettes is disposed. Each of the medicine cassettes reserves a plurality of medicines of one kind. Each of the medicine cassette may dispense the medicine at one tablet unit. The controller 8 described below discharges the medicines by driving each of the medicine cassettes for the number to the extent of the kind designated by the prescription data and the number designated by the prescription data to the hopper 12.

Figure 2:
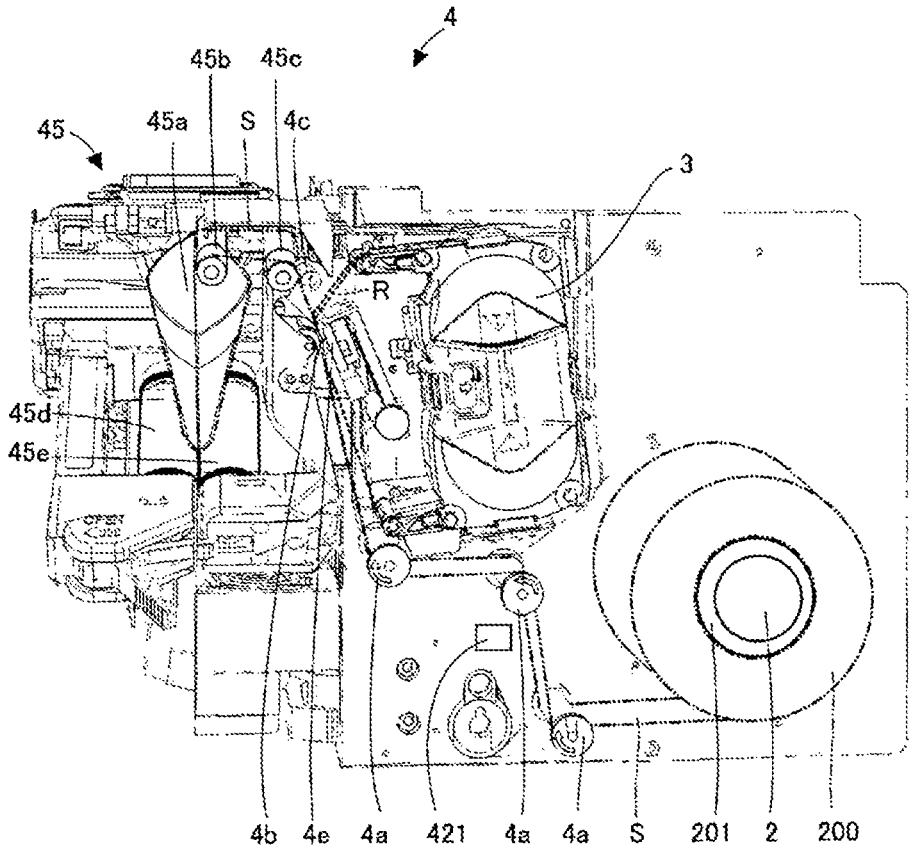
FIG. 2 An explanatory diagram of a wrapping unit of a medicine wrapping apparatus shown in FIG. 1.

FIG. 2 is a drawing illustrating one example of the wrapping unit 4 in the state that the wrapping paper roll 200 and the ink ribbon cassette 3 are mounted. In FIG. 2, also a medicine wrapping part 45 is illustrated. The medicine wrapping part 45 is a functional part for introducing, for example, the medicine from an opening of the two folded dispensing paper S and for performing thermal bonding the dispensing paper S so as to enclose the medicine just introduced. The dispensing paper S may be passed with hanging on three guiding shafts 4*a*, then passing between a backup roller 4*b* and a printing head 4*e* and then hanging on a guiding shaft 4*c*. Furthermore, an ink ribbon R contained in the ink ribbon cassette 3 is guided by a tape guide of the wrapping unit 4 with passing between the backup roller 4*b* and the printing head 4*e*, after printed, then being separated from the dispensing paper S, and then returning to the ink ribbon cassette 3.

In addition, as shown in FIG. 2, for example, at a near position of the guiding shaft 4*c* for guiding the dispensing paper S (at a downstream side along to a conveying direction of the dispensing paper S), curved and rotatable guiding rollers 45*b*, 45*c* are disposed for making the conveying direction of the dispensing paper S curve just before an expansion guide 45*a* of the medicine wrapping part 45. At a back side of the expansion guide 45*a*, an introduction member for introducing the medicine into the dispensing paper S 73 (refer to FIG. 3) (hereafter referred to a medicine wrapping hopper) is disposed. The medicine wrapping hopper 73 has a tapered shape being narrow as going to a lower side. The extension guide 45*a*, by extending the two folded dispensing paper S, forms opening for introducing a nozzle of the medicine wrapping hopper 73. Also, the medicine wrapping part 45 comprises below the expansion guide 45*a* a pair of heater rollers 45*d*, 45*e*. Furthermore, below the heater rollers 45*d*, 45*e* a feeding roller (not shown in the figure) is disposed. These heater rollers 45*d*, 45*e* are driven rotationally by a driving mechanism not shown in the figure comprising a motor, a direct driving gear and an intermittent gear and the like. By rotation of the heater rollers 45*d*, 45*e* with sandwiching the dispensing paper, the dispensing paper S may be conveyed. Here, the printing function is not necessary as the function of the wrapping unit 4 and the medicine dispensing apparatus 1 may comprise a wrapping unit 4 without the printing function.

Figure 3:
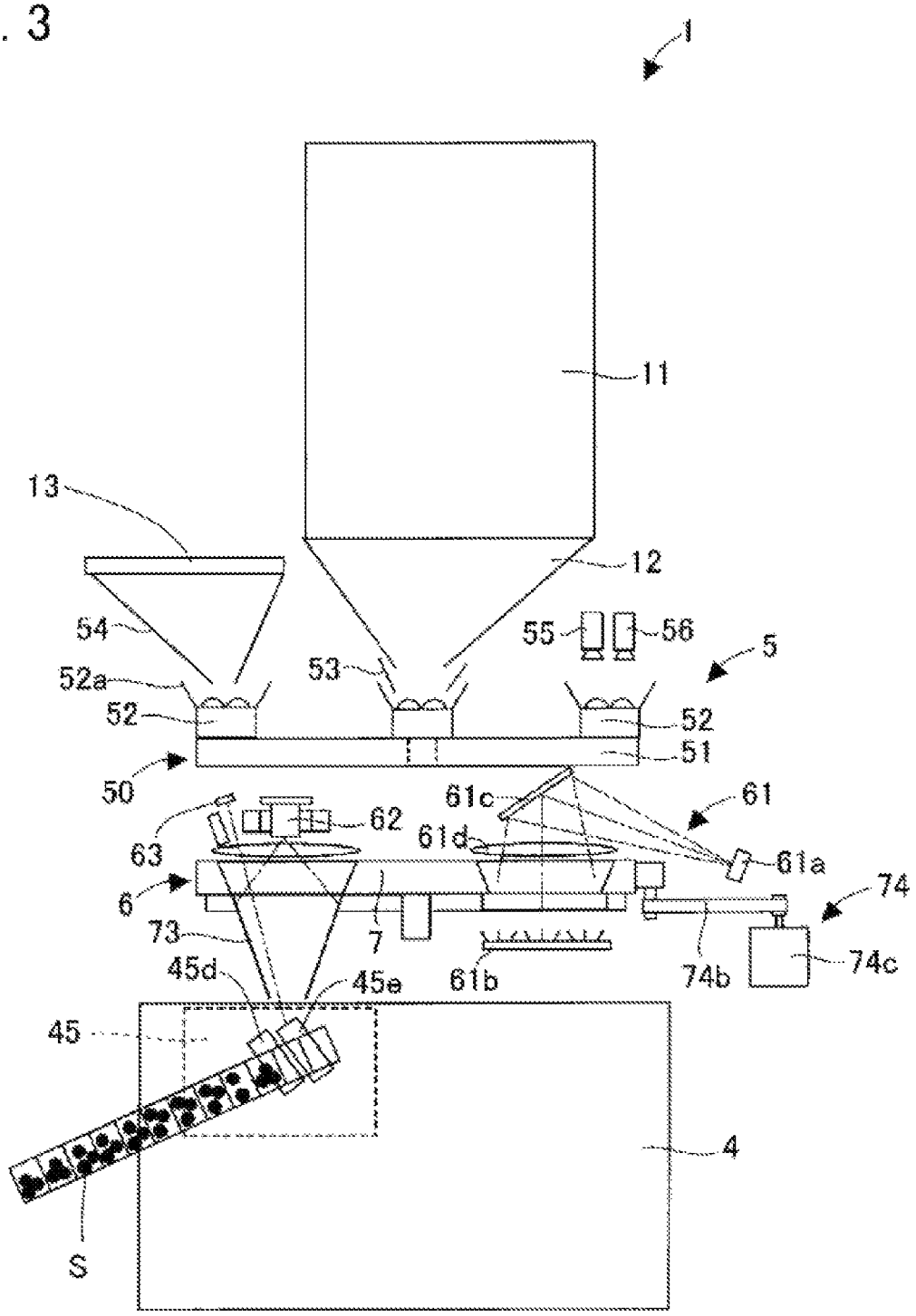
FIG. 3 An explanatory diagram illustrating a schematic construction of a medicine check part of a medicine dispensing apparatus shown in FIG. 1.

FIG. 3 illustrates a schematic construction of the whole medicine dispensing apparatus 1. The medicine check part 5 is positioned between the medicine containing/dispensing unit 11 and the wrapping unit 4 and is consisted of a medicine identification part 50 disposed at an upper side and a medicine number check part 6 disposed at a lower side.

Figure 4:
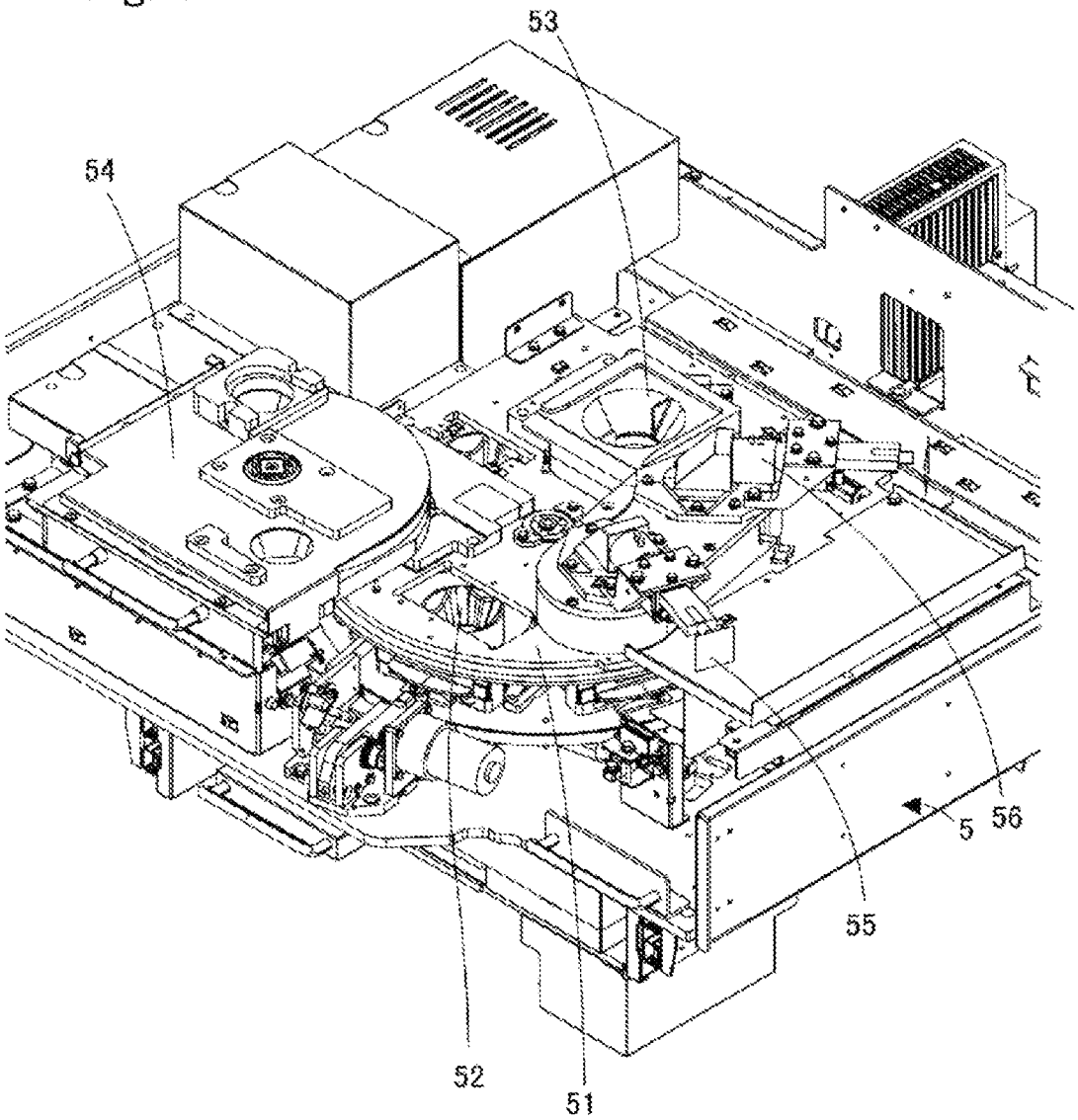
FIG. 4 A perspective view of a medicine identification part of a medicine dispensing apparatus shown in FIG. 1.
Figure 5:
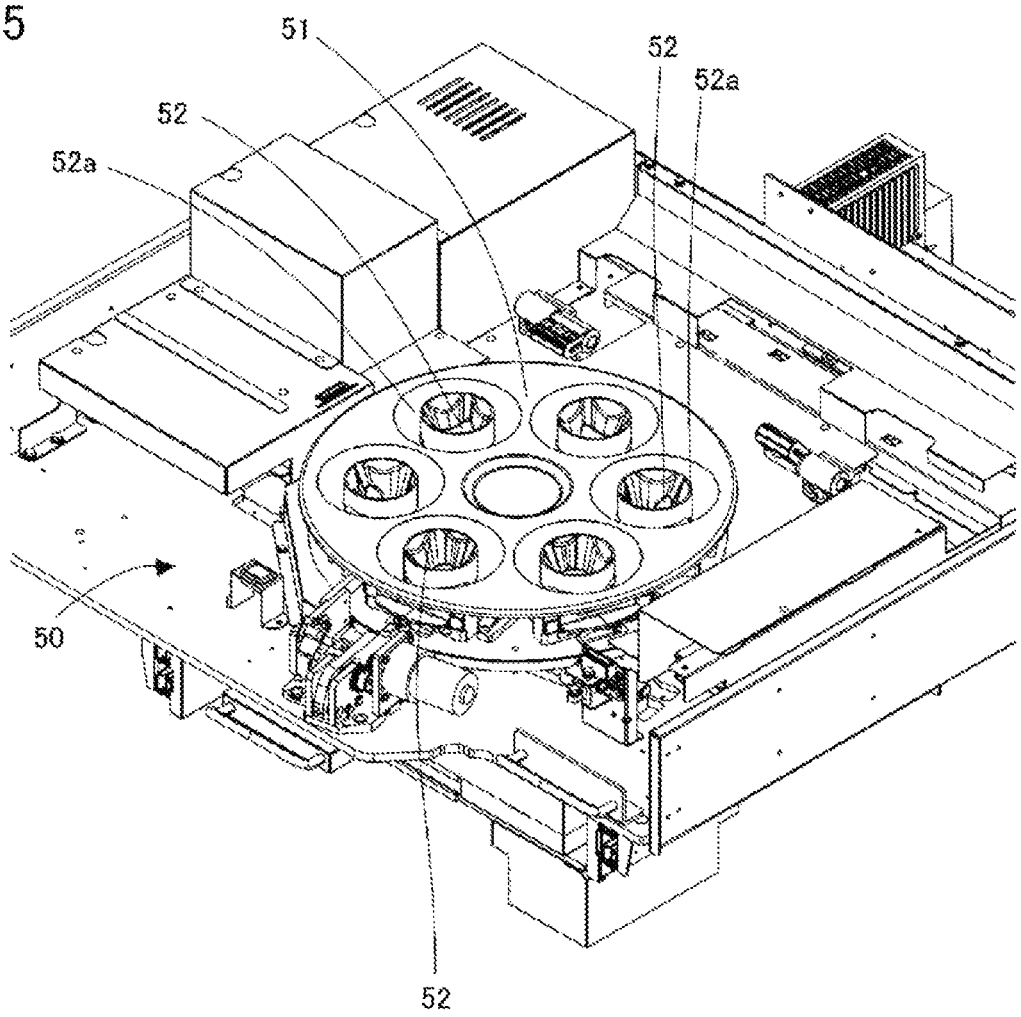
FIG. 5 A perspective view of FIG. 4 omitting a first camera device and a second camera device.

The medicine identification part 50 comprises, as shown in FIG. 4 and FIG. 5, a turn table 51 rotatable in a horizontal plane. To the turn table 51, six medicine rotation parts 52 are disposed on the same circumference about the rotation axis thereof. To one position of the six medicine rotation part 52, the introduction part 53 for introducing the medicine from the hopper 12 into the medicine rotation part 52 is disposed and to the other one position, a hand distribution medicine introduction part 54 for introducing the medicine from the hand distribution part 13 is disposed; also to other one position, a first camera 55 for photographing the inside of the medicine rotation part 52; and to further other one position, a second camera 56 for photographing the inside of the medicine rotation part 52. That is to say, by the rotation of the turntable 51, the medicine rotation part 52 moves below the introduction part 53, below the hand distribution medicine introduction part 54, below the first camera device 55, below the second camera device 56 and above the hopper 64 such that the medicine enters to the medicine rotation part 52 at the introduction part 53, 54 and falls down to the hopper 64 from the medicine rotation part 64 at upper side of the hopper 64. Now, the first camera device 55 and the second camera 56 are positioned at the same positionings in FIG. 3 as convenience.

Also, in each of the medicine rotation parts 52, a pair of rollers are disposed with facing the peripheral faces thereof oppositely such that by rotating the pair of the rollers the medicine fallen in the medicine rotation part 52 may be made to rotate. By the rotation of the medicine, opportunities for making faces on which stamps or marks of the medicines are provided face up are provided. Furthermore, by separating widely the pair of the rollers each other, the medicine may be made to fall down to the lower side. Now, when the medicine rotation part 52 is positioned above the hopper 64 described later, the pair of the rollers of the medicine rotation part 52 is made to separate. The first camera device 55 is one that projects light from a light source not shown in the figure to a direction from a camera side toward the medicine and is adapted to take photographs of the medicines provided with the identification information mainly by stamping. Furthermore, the second camera device 56 is one that projects light from a light source not shown in the figure to a direction from a camera side toward the medicine and is adapted to take photographs of the medicines provided with the identification information mainly by printing. Now, when an identification check of stamping and/or printing of the medicine using each of the medicine rotation part 52 of the medicine identification part 50 is performed, the identification check is made by throwing down the medicine one by one to each of the medicine rotation part 52 from the medicine containing/dispensing unit 11 and the like. That is to say, to one of the medicine rotation part 52, only one medicine is thrown down. By collating the stamped or printed identification information and the prescription data, determination may be done whether or not right medicines are dispensed from the medicine supply part or the hand distribution supply part. On the other hand, when the identification check of the stamped or printed identification information using each of the medicine rotation part 52 of the medicine identification part 50 is not made, the medicine may be made to fall down to the medicine rotation part 52 for every one dose package. When the identification check is not made, the medicine for one dose package fallen down to the medicine rotation part 52 may be photographed or may not be photographed and the collation of the identification information and the prescription data is unnecessary. Furthermore, to each of the medicine rotation part 52, a lens 52 having a ring shape is disposed for guiding the light of the lighting to the side of the pair of the rollers.

Figure 6:
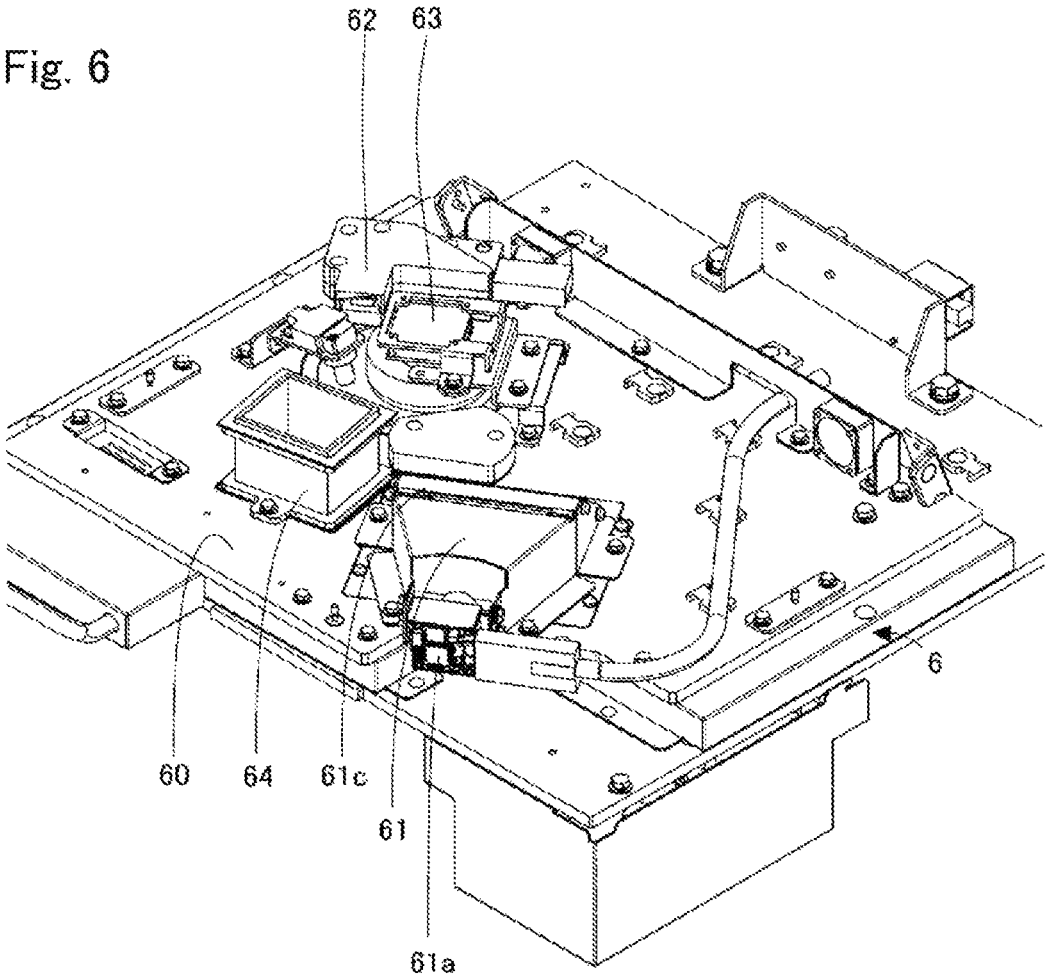
FIG. 6 A perspective view of a medicine check part of a medicine dispensing apparatus shown in FIG. 1.
Figure 7:
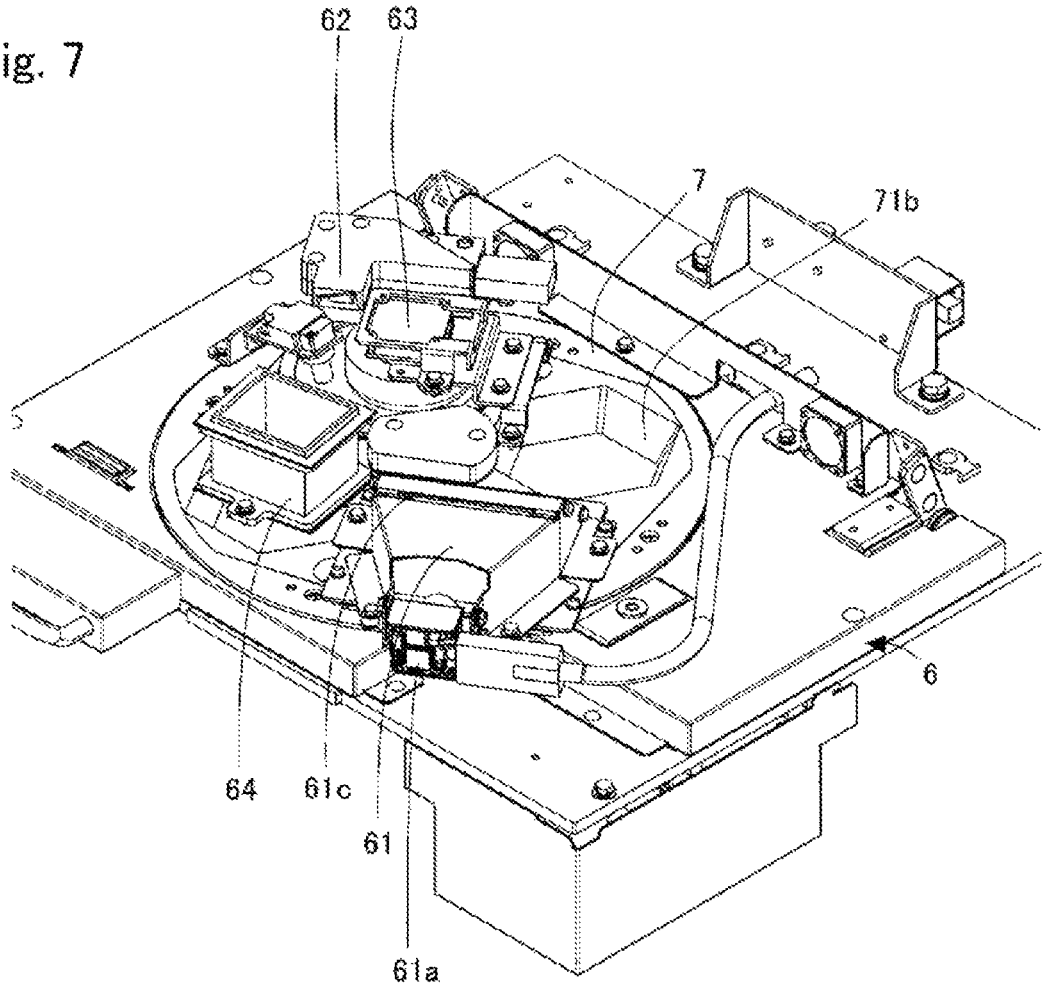

The medicine number check part 6 is disposed at the lower side of the turn table 51 as a layered state and may be used to count the number of the medicines for one dose package. In addition, the medicine number check part 6 comprises on a substrate 60, also as shown in FIG. 6 and FIG. 7, a third camera device (photographing part for counting) 61, a fourth camera device (hopper photographing part) 62, a fifth camera device (seal part photographing part) 63 and a hopper 64. In addition, at the lower side of the substrate 60, a rotation plate 7 of the medicine number check part 6 is disposed, and the medicine fallen down from the medicine rotation part 52 to the hopper 64 is supplied to the rotation plate 7.

Figure 8:
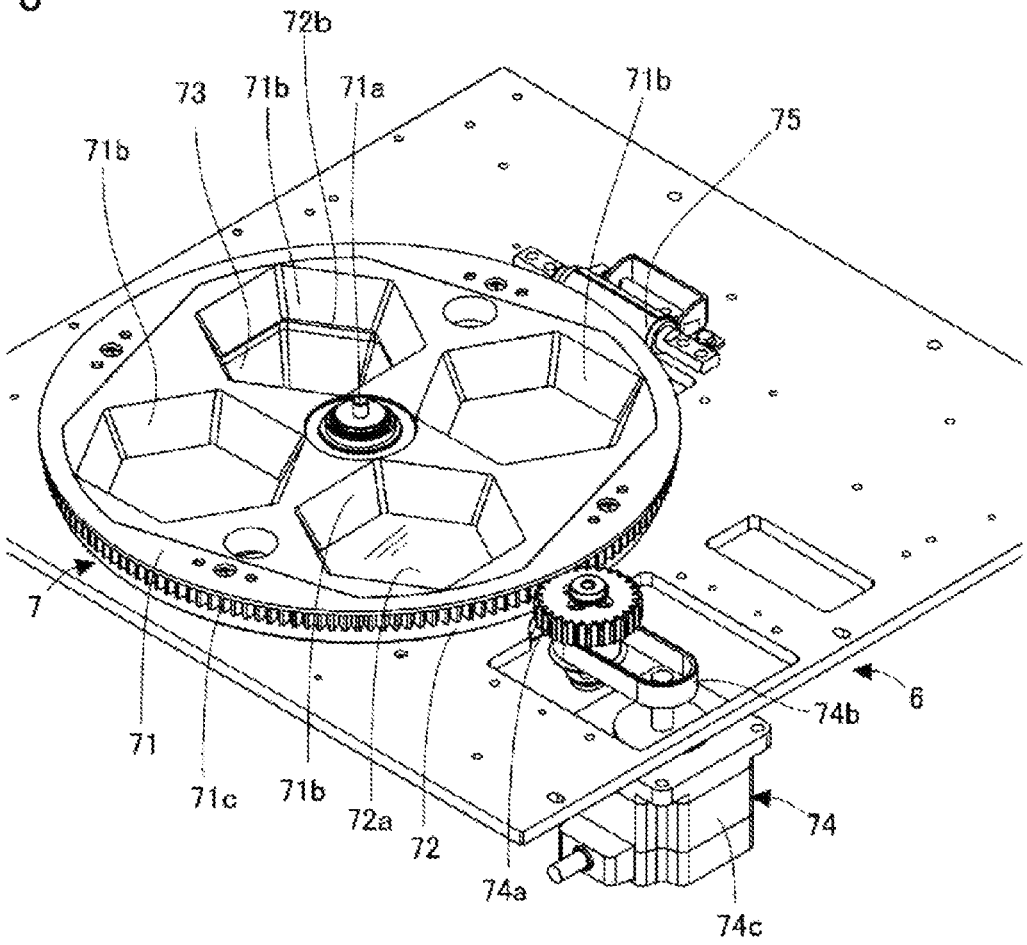
FIG. 8 A perspective view of a rotation plate and the like in a medicine number check part shown in FIG. 6.

The rotation plate 7, as shown in FIG. 8, comprises a medicine receiving plate part 71 having a circular shape and a medicine receiving bottom part 72. The medicine receiving part 71 has for example four (plural) bottomless opening parts 71*b* at the same circumference about a rotation axis 71*a* and receives the medicines supplied to each of the bottomless opening part 71*b* from the medicine containing/dispensing unit 11 through the hopper 64. Incidentally, the medicine receiving bottom part 72 functions as a bottom part of the bottomless opening part 71*b* and comprises a light passing part 72*a* for passing the light at a particular position where the bottomless opening part 71*b* is positioned due the rotation of the medicine receiving plate part 71*b* by the rotation of the medicine receiving plate part 71 and on the other hand comprises a wrapping opening part 72*b* for supplying the medicines in the bottomless opening part 71*b* at the other particular position where the bottomless opening part 71*b* is positioned due the rotation of the medicine receiving plate part 71*b* by the rotation of the medicine receiving plate part 71.

Figure 9:
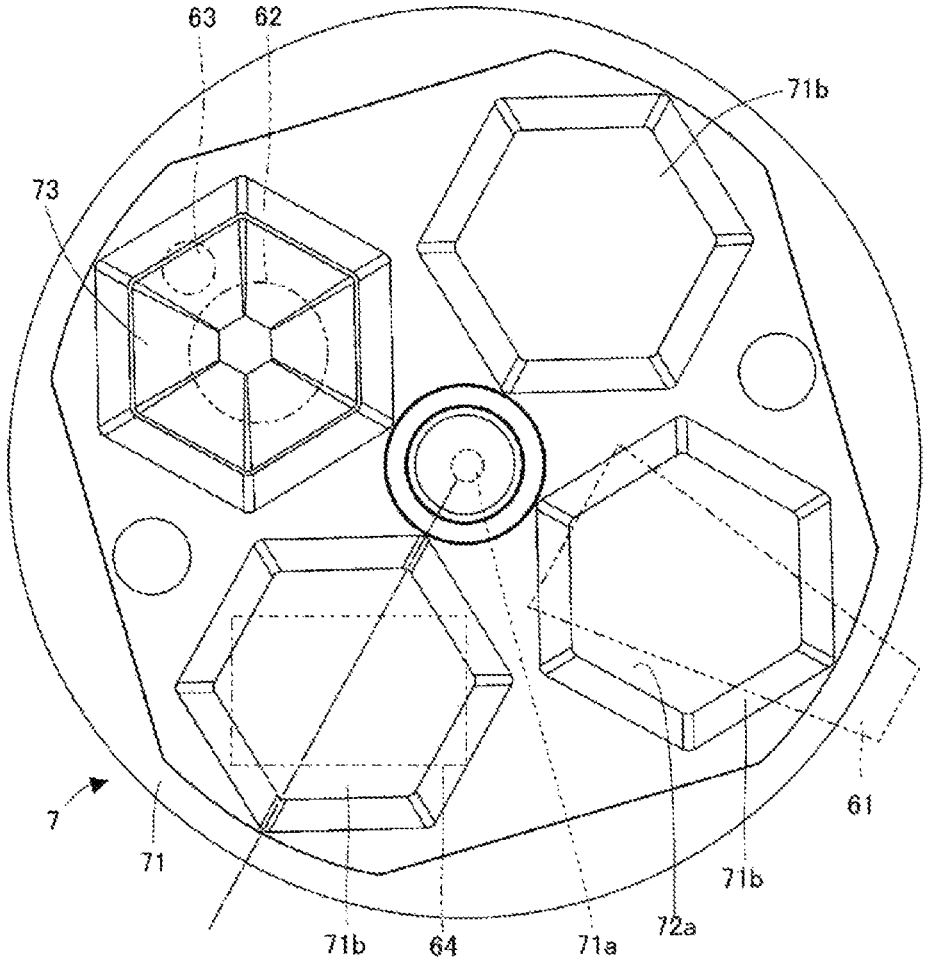

The medicine receiving plate part 71 is driven rotationally by a driving part 74. At an outer peripheral part of the medicine receiving plate part 71, a gear part 71*c* is formed. In addition, to the gear part 71*c*, the drive gear 74*a* of the driving part 74 is engaged. Over an axis part of the driving gear 74*a*, a belt 74*b* is installed and the belt 74*b* is rotated by the motor 74*c*. By controlling the motor 74*c*, the medicine receiving plate part 71 is made to rotate intermittently to one direction to move the bottomless opening par 71 *b* to the above particular position and the other particular position and the like. Furthermore, by controlling the motor 74*c* under the condition that the medicine receiving plate part 71 rotates normally or reversely while switching a rotational direction of the medicine receiving plate part 71 reversely, the overlapping of the medicines in the bottomless opening part 71*b* may be cancelled. At least any one of a rotational speed before switching of the rotational direction and a rotational speed after switching of the rotational direction may be higher than a rotational speed of the medicine receiving plate part 71 for making the bottomless opening part 71*b* move the particular position and the other particular position. Incidentally, at a near vicinity to the medicine receiving plate part 71, a stopper device 75 is disposed. The stopper device 75, when stopping driving of the medicine receiving plate part 71, functions so as to stop immediately the rotation by contacting a contacting part not shown in the figure to the bottom of the medicine receiving plate part 71.

each of the bottomless opening part 71*b* has, as shown in FIG. 9, a regular hexagonal shape, but not limited thereto, may have a circular shape and the like. However, as the regular hexagonal shape, it is desired that at least a lateral wall faces of a position far from the rotational axis 71*a* of the medicine receiving plate part 71 among the lateral wall faces of each bottomless opening part 71*b* are formed such that a plurality of edge parts (for example, linear parts) are continued with being provided an angle. The angle provided to the edge parts may be preferred to be not less than 90 degrees and to be less than 180 degrees. Furthermore, it is desired that one of joint parts (corner part) of the adjacent edge parts is positioned to be located farthest from the rotational axis 71*a*.

Incidentally, the lateral wall face of the bottomless opening part 71*b* having the regular hexagonal shape has an inclined shape of which opening area becomes wider as going to the upper side thereof. Also, this is not limited to the regular hexagonal shape and at least the lateral wall face among the bottomless opening part 71*b* positioned at a far side from the rotational axis 71*a* of the medicine receiving plate part 71 may have the inclined shape slanting apart from the rotational axis 71*a* as going to the upper side. An angle of the inclination is, for example, to be about 25 degrees to a vertical direction. Here, in the medicine wrapping hopper 73, at least the upper part side thereof, if the bottomless opening part 71*b* has the regular hexagonal shape, may have similar regular hexagonal shape. Furthermore, from the bottomless opening part 71*b* to the medicine wrapping hopper 73, it may be preferred that the inclination is continued without a step. Further described in detail, it may be preferred that an upper end face of the wrapping opening part 72*b* has the same shape with the lower end part of the bottomless opening part 71*b*, and the lower end face of the wrapping opening part 72*b* has the same shape with the upper end part of the medicine wrapping hopper 73. Furthermore, the lateral wall face of the bottomless opening part 71*b* having the regular hexagonal shape may have an inclined shape of which opening area becomes wider as going to the lower side.

Figure 11:
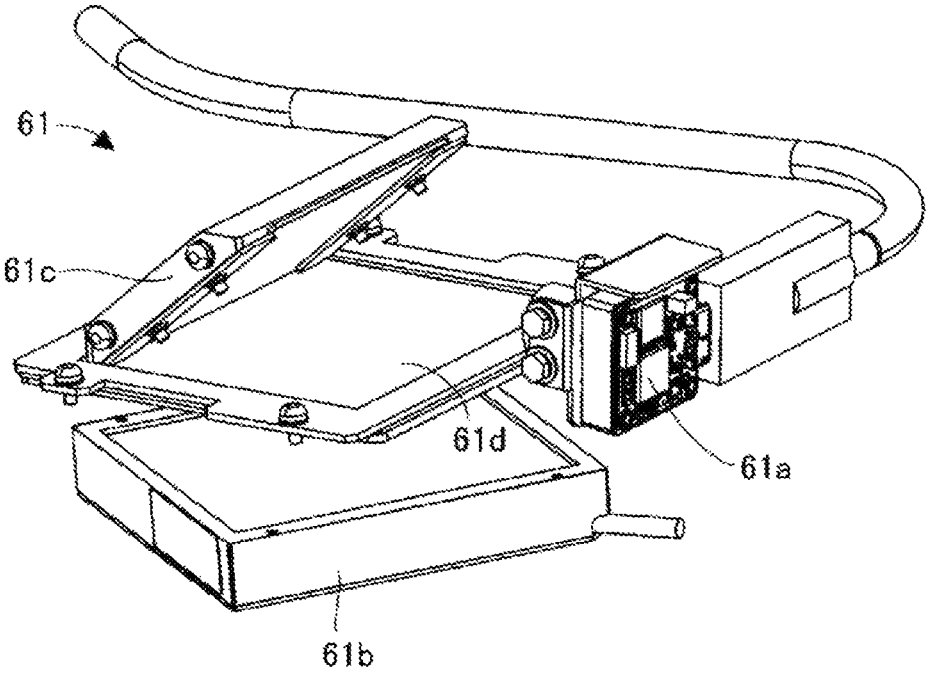
FIG. 11 An enlarged perspective view of a third camera device shown in FIG. 6.

The third camera device 61 as shown in FIG. 3, FIG. 7 and FIG. 11 comprises an imaging element 61*a* disposed at a position outside of the medicine receiving plate part 71, a lighting part 61*b* for projecting the lighting light to the light passing part 72*a* from a lower side of the light passing part 72*a* of the medicine receiving part 72, a reflection member 61*c* for guiding the light projected from the lighting part 61*b* and passed to the upper side through the light passing part 72*a* toward the imaging element 61*a* by reflecting on a reflection face (metal polished face, plating face and the like), and a lens 61*d* disposed above the light passing part 72*a*. The imaging element 61*a* may be one that utilizes a CCD or a CMOS and like. The lighting part 61*b* may be one that utilizes a plane light source. Furthermore, the lens 61*d* may be one that utilizes a hologram or a diffraction grating.

The reflection member 61*c* reflects the light passing to the upper side through the light passing part 72*a* toward a direction almost parallel to the upper face of the medicine receiving plate part 71. Particularly, in this embodiment, the reflection member 61*c* is disposed such that the reflection face is to be not more than 45 degrees in an elevation angle. Furthermore, the imaging element 61*a* is positioned such that the whole or a part thereof is positioned below the upper face of the substrate 60 and the corresponding position of the substrate 60 is notched one. Since the medicine has a property that does not pass the light or does not pass a part of the light, an image area at the part where the medicine is present on the light passing part 72*a* becomes low.

Figure 12:
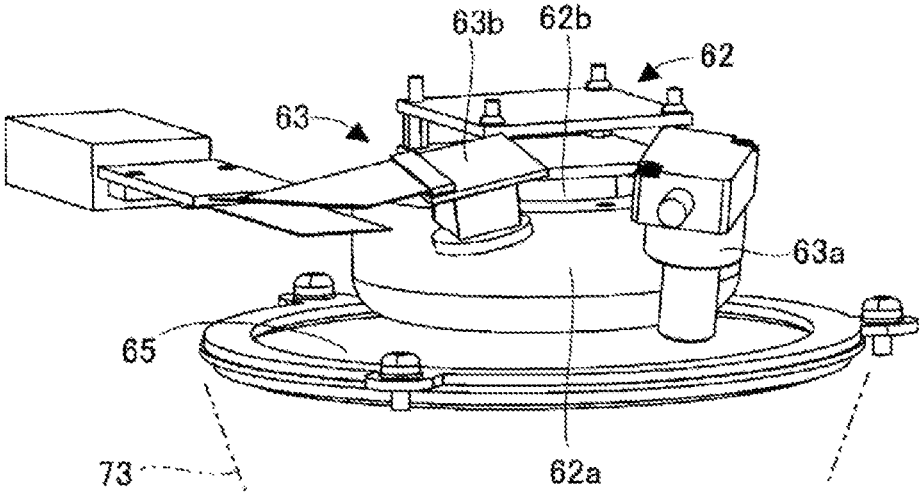
FIG. 12 An enlarged perspective view of a fourth camera device and a fifth camera device shown in FIG. 6.

The fourth camera device 62, as shown in FIG. 3 and FIG. 12, is consisted of the lighting part 62*a* having an ring shape and a photographing part 62*b* disposed at the center side of the lighting part 62*a*. The lighting part 62*a* projects an inner wall face of the medicine wrapping hopper 73 as even as possible. Furthermore, the photographing part 62*b* takes an image of an inner wall face of the medicine wrapping hopper 73 in a wide angle. In this imaging, if the medicine is adhered on the inner wall face due to static electricity and the like, the medicine is imaged. The inner wall face of the medicine wrapping hopper 73 has white color. When the inner wall face has white color as described above and the medicine has a white color, a shadow of the medicine may be detected clearly. Now, when there are fears that the medicine adheres to a lateral wall face of the bottomless opening part 71*b*, the lateral wall face may be provided with the white color and the imaging area of the fourth camera device 62 is set to include the lateral wall face of the bottomless opening part 71*b*.

The fifth camera device 63 is consisted of a lighting part 63*a* for providing spot lighting and a photographing part 63*b* adjacent to the lighting part 63*a*. The lighting part 63*a* projects the inside of the dispensing paper near a wrapping seal part (the part of the heater roller 45*d*, 45*e*) in the medicine wrapping part 45 positioned below the medicine wrapping hopper 73. The photographing part 63*b* takes the image in zooming. The imaging area of the photographing part 63*b* is the inside of the medicine wrapping hopper 73.

At a position above the medicine wrapping hopper 73 and also above the bottomless opening part 71*b*, a lens 65 is disposed. This lens 65 may be one that utilizes the hologram or a diffraction grating.

Figure 13:
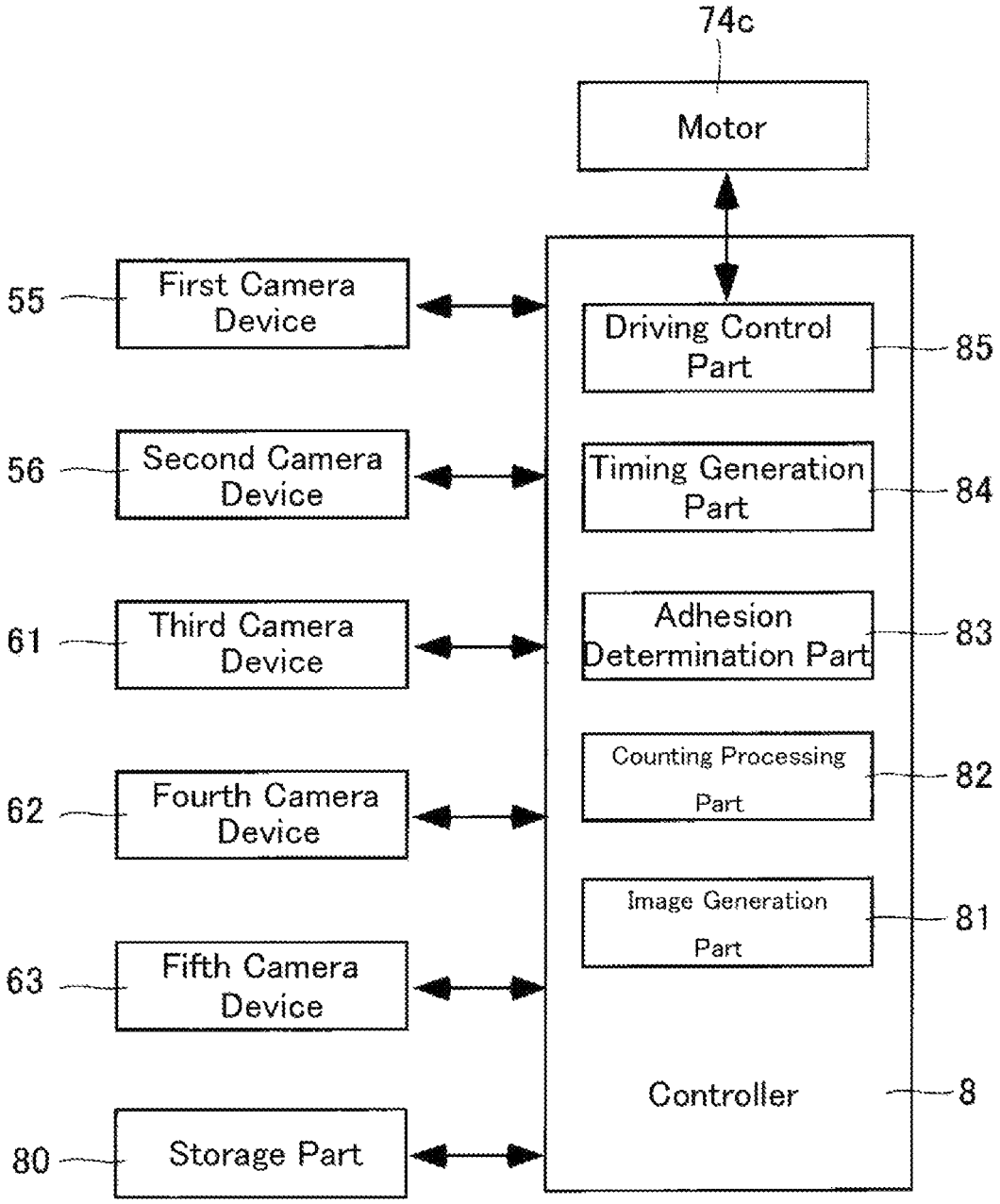
FIG. 13 A schematic bullock diagram showing a part of a control system of a medicine dispensing apparatus of FIG. 1.

FIG. 13 illustrates a schematic block diagram of a control system of the medicine dispensing apparatus 1. In a storage part 80 connected to a controller 8 of the medicine dispensing apparatus 1, so-called master table (medicine and so on database), a prescription data of each patient, image data and the like photographed by the first-fifth cameras 55, 56, 61-63 are stored. Furthermore, actuation timings of the first-fifth cameras 55, 56, 61-63 are controlled by the controller 8 for lighting and photographing are controlled by the controller 8.

A image generation part 81 of the controller 8 performs a processing to store the images photographed by the first-fifth cameras 55, 56, 61-63 in the storage part 80, and particularly, the image data photographed by the first-fifth cameras 55, 56, 61-63 are stored in the storage part 80 as identification data. Also, the images photographed by the fifth camera device 63 are stored in the storage part 80 as images of wrapping seal part.

A counting processing part 82 of the controller 8 counts, based on the images photographed by the third camera device 61, the number of regions having low luminance values within each bottomless opening part 71*b* as the number of medicines. The third camera device 61 takes photographs of the shadows of the tablets such that the counting processing part 82 counts, for example, black regions in the photographed image and then outputs the number of regions as the number of medicines. The black regions include not only circular shaped block regions but also block regions having doughnut (toroidal) shapes.

An adhesion determination part 83 of the controller 8 determines, based on the images photographed by the fourth camera device 62, the adhesion of the medicine in the medicine wrapping hopper 73. For example, the adhesion determination part 83 determines the adhesion of the medicine in the medicine wrapping hopper by comparing the images photographed with the fourth camera device 62 upon wrapping the medicine package with a basic image photographed under the condition that the medicine does not adhere to the inner wall face of the medicine wrapping hopper 73. The basic image may be the image photographed just before the day's first dispensing processing and the image may be stored in the storage part 80. In addition, as for one example of the adhesion determination of the medicine, for example, the determination that the medicine is adhered in the medicine wrapping hopper 73 may be made if pixels of which luminance values match each other or are to be within a predetermined region for every pixel of the imaging element is less than a predetermined rate to the whole pixel number. The controller 8, when determined that the medicine adheres in the medicine wrapping hopper 73, may output an alarm. In such case, the medicine wrapping processing may be continued or may be interrupted. In addition, the images photographed when the determination is made that the medicine adheres in the medicine wrapping hopper 73 may be stored in the storage part 80.

Figure 14:
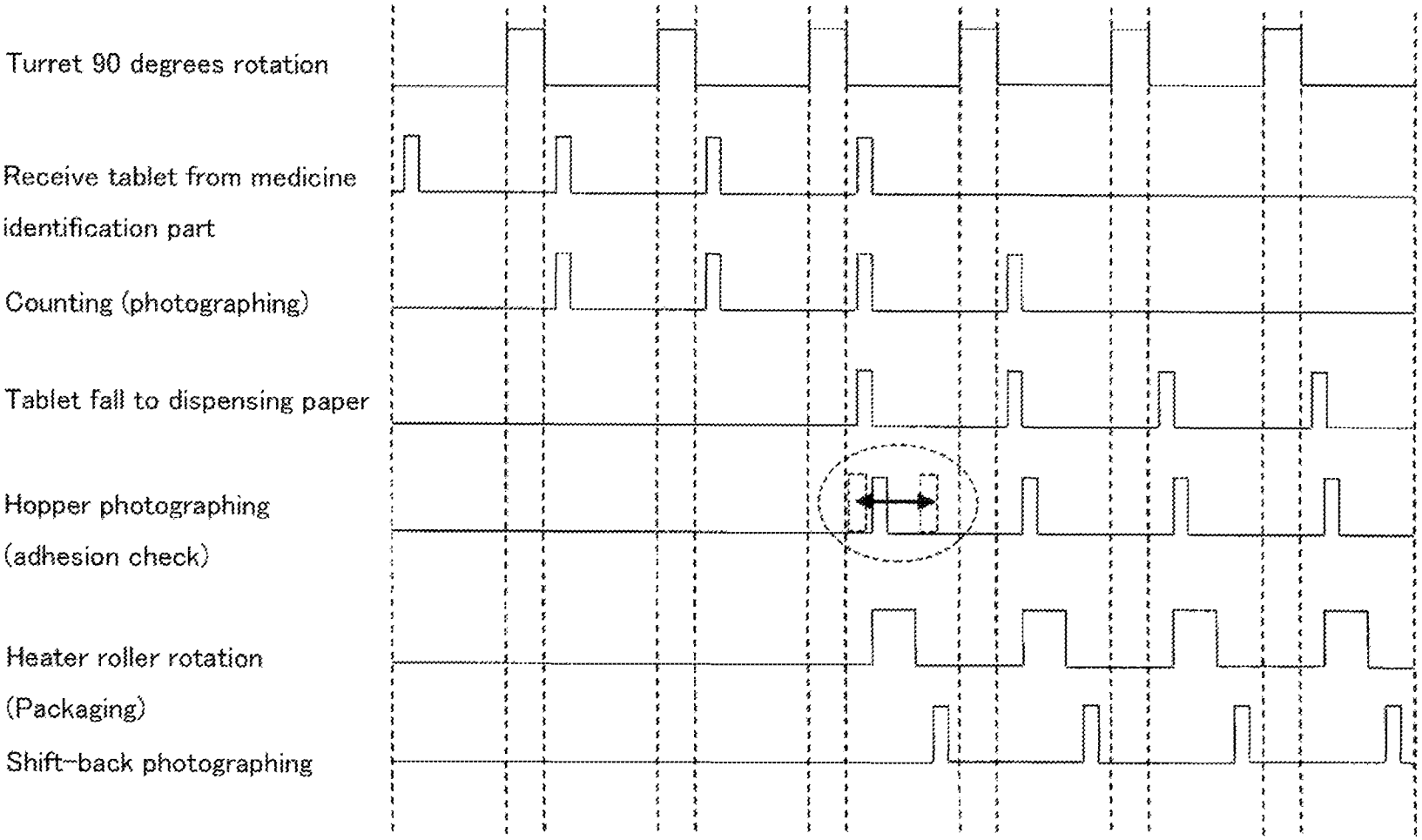
FIG. 14 A timing chart showing one example of a motion timing of a medicine dispensing apparatus of FIG. 1.

FIG. 14 illustrates a timing chart when the medicines for one dose package are made to fall down to the medicine rotation part 52 altogether. A timing generation part 84 of the controller 8, upon performing the number check (medicine photographing) by the medicine number check part 6, as shown in FIG. 14, generates the timing for intermittent 90 degrees rotation motions of the medicine receiving plate part 71 in the rotation platter 7 of the medicine number check part 6 (in FIG. 14, described as a turret). Also, the timing generation part 84 generates the timing for receiving the medicines (medicines for one dose package) from the medicine identification part 50. This reception may be performed before the intermittent rotation motion of the medicine receiving plate part 71. Furthermore, in the timing after the intermittent rotation motion (medicine stational state), photographing by the third camera device 61 is performed, and then the medicine counting processing for one dose package in the bottomless opening part 71*b* is performed by the counting processing part 82. Here, the photographing of the third camera device 61 is performed before the medicines for one dose package made to fall into the dispensing paper in the medicine wrapping part 45 by the medicine wrapping hopper 73; however, the medicine counting processing may be performed after the medicines for one dose package made to fall into the dispensing paper in the medicine wrapping part 45 by the medicine wrapping hopper 73.

A medicine fall for wrapping to the dispensing paper S (medicine fall to the medicine wrapping hopper 73) may be performed on or after the third intermittent rotation motion of the medicine receiving plate part 71. Also, the timing generation part 84 generates a hopper photographing timing (medicine adhesion check) by the fourth camera device 62. This photographing timing may be delayed slightly from the medicine fall timing into the dispensing paper S. Here, the timings for the medicine adhesion check (image judgement processing) and the hopper photographing are not necessary to be simultaneous. The medicine adhesion check may be performed any time after the hopper photographing has been performed.

In addition, the timing generation part 84 generates a rotation (packaging) timing of the pair of the heater rollers

45*d*, 45*e* (wrapping seal part) in the medicine wrapping part 45. The rotation of the heater rollers 45*d*, 45*e* is slightly delayed from the start of the medicine fall into the dispensing paper S. Furthermore, the timing generation part 84 generates a photographing timing of the fifth camera device 63 in the wrapping seal part. This photographing is performed after the rotational motion (after medicine packaging). Here, when the heater roller 45*d*, 45*e* are rotated, there are fears that one or plural medicines are shifted to a back side (downstream side along to the conveying direction) from a seal area for one dose package of the dispensing paper S. By performing the photographing, the shifted back of the medicine to the back side may be determined.

Now, the hopper photographing (adhesion check) may be delayed slightly from the timing of the medicine fall into the dispensing paper S, but not limited to, the hopper photographing may be performed before the medicine fall into the dispensing paper S during the rotation (packaging) of the heater rollers 45*d*, 45*e*, or after that (dashed line in FIG. 14). When the hopper photographing is performed before the medicine fall into the dispensing paper S, it is determined whether or not the medicine to be wrapped in the prior wrapping motion than the current packaging motion is remained in the medicine wrapping hopper 73.

A driving control part 85 of the controller 8 controls the motor 74*c*. In this control, the control includes not only the intermittent 90 degrees rotational motion of the medicine receiving plate part 71 but also a control for cancelling the overlap of the medicines in the bottomless opening part 71*b* by rotating normally and/or reversely the medicine receiving plate part 71. The normal and/or reverse rotational motion (overlap cancellation) may not be limited only before the photographing of the third camera device 61. After the photographing of the third camera 61 and if the number counted by the counting processing part 82 and the dispensed number according to the prescription data do not coincide, the controller 8 may perform again the normal and/or reverse rotation motion (overlap cancellation). Furthermore, if in the counting after a plurality of the overlap cancellation processings the counted number and the dispensed number according to the prescription data do not coincide, the controller 8 may output an error. In addition, at a medicine discharge port of each medicine cassette, a discharge sensor for detecting the number of medicines discharged may be disposed. If the number of medicines detected by the discharge sensor does not coincide with the prescription data, the medicine counting processing is performed plural times as described below. That is to say, first the photographing is performed by the third camera device 61, and based on the photographed image the counting processing part performs the medicine counting processing. Next, the medicine receiving plate part 71 is made rotate normally; the second photographing by the third camera device 61 is performed, and based on the photographed image the counting processing part 82 performs the second medicine counting processing. The plurality of counting processings is performed as described above, if each of the counting processings is the same with each other, the medicine dispensing apparatus 1 determines that the numbers of medicine instructed by the prescription data is discharged.

In the above construction, the medicine check part 5 determines whether or not the medicine adheres to the medicine wrapping hopper 73 used for making the medicines for one dose package fall into the dispensing paper S in the medicine wrapping part 45 such that the possibility may be determined, which the medicine supplied from the medicine receiving/dispensing unit 11 (medicine supply part) is not actually wrapped.

In addition, as the above embodiment, even if the medicine wrapping hopper 73 is disposed between the medicine number check part 6 and the dispensing paper (or wrapping unit 4), by photographed with the third camera device 61, it become easy to assure whether or not the medicines subjected to the medicine counting processing are packaged into the dispensing paper.

When assumed that the detection is not performed with respect to the adhesion or not to the medicine wrapping hopper 73, in order to assure the packaging of the medicines corresponding to the number counted by using the medicine number check part 6 are wrapped into the dispensing paper, it is necessary to dispose the medicine check part 6 just above the dispensing paper. Thus, the medicine number check part 6 can not be disposed at an optional position. As the present invention, by detecting whether or not the medicine adheres to the medicine wrapping hopper 73, even if the medicine number check part 6 is disposed at an upstream side from the medicine wrapping hopper 73, it is assured that the medicines of the number counted by using the medicine number check part 6 are wrapped in the dispensing paper. Thereby, the option for the position placing the medicine number check part 6 becomes wider.

The adhesion of the medicine may be properly determined with disposing the adhesion determination part 83 determining the adhesion of the medicine in the medicine wrapping hopper 73 based on the comparison between the image taken by the third camera device (hopper photographing part) 61 and the basic image photographed under the condition that the medicine is not adhered on the inner wall face of the medicine wrapping hopper 73.

If before the medicines for one dose package is made to fall into the dispensing paper S in the medicine wrapping part 45 by the medicine wrapping hopper 73, the medicines for one dose package is received once and the light is projected to the medicine under the condition that the medicine for one dose package is in a stationary state and then the number of medicines for one dose package is counted based on the shaded images of the medicines by this light, accuracy of the counting may be improved by making hard to suffer disadvantages of a medicine color and a transparency.

If the medicine number check part 6 has a construction having the rotation plate 7 consisted of the medicine receiving part 71 and the medicine receiving bottom part 72, a height of the medicine number check part 6 (medicine check part 5) may be lowered.

When rotating normally and reversely the medicine receiving plate part 71 in a high speed to cancel the overlap of the medicines in the bottomless opening part 71*b*, the erroneous counting due to the overlap of the medicines may be decreased. Now, in such normal and reverse rotations, the following control may be performed.

For example;

rotating reversely and slightly the medicine receiving plate part 71 (pushing out the medicines in an accelerated state):

next rotating thereof normally in a high speed (making the medicine at the lower side pop out quickly):

next rotating normally and slightly (demolishing the medicines supported by the lateral wall face and the medicines at two points)

next rotating thereof reversely in a high speed (setting to a lower speed than that in the normal rotation so as not to dash off the medicine and to further demolish the demolished medicines).

Among the lateral wall faces of the bottomless opening part 71*b*, when at least the lateral wall face at the far side from the rotation axis 71*a* of the medicine receiving plate part 71 is inclined such that the lateral wall face becomes far from the rotation axis 71*a* as going to the upper side, in the medicines overlapping up-and-down while contacting the lateral wall face, the state that the upper medicine riding above is positioned at the outer side (centrifugal side) with respect to the center of the medicine positioned lower may be easily provided such that the overlap of the medicines may become easily cancelled. Here, the inclination of the lateral wall face may include not only the linear inclination but also a stepwise inclination or a curved inclination.

If the lateral wall face of each of the bottomless opening part 71*b* is formed such that the plurality of the corner parts is formed continuously providing with an angle, for example, when the rotation of the medicine receiving plate part 71 is stopped, the inertial movement of the medicines overlapped up-and-down while contacting the lateral wall face becomes hard to become a simple movement to the rotational direction of the medicine receiving plate part 71, which tends to occur in the case that the lateral face has a simple circular arc and the like, the overlap of the medicines may become easy to be cancelled.

Figure 10:
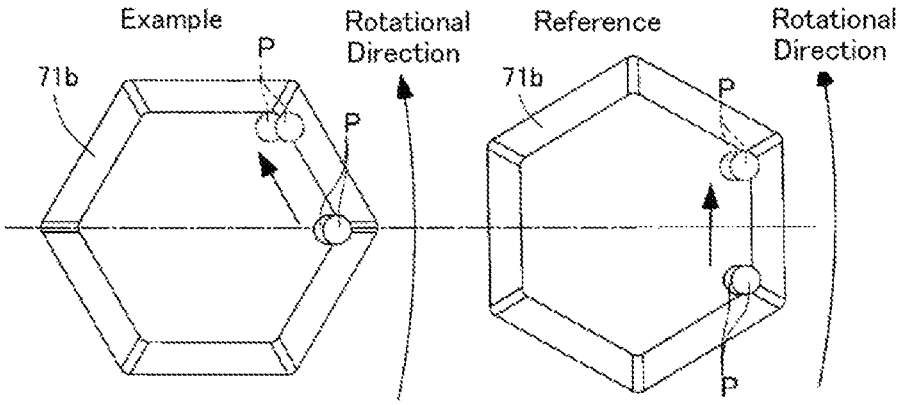
FIG. 10 An explanatory diagram showing a bottomless opening part of a rotation plate shown in FIG. 9 and a bottomless opening part as a reference example with a different angle.

In the construction that the lateral wall face has the plurality of edge parts, as shown in FIG. 10 (A), one of the joint positions (corner part) between the adjacent edges is located farthest from the rotation axis 71*a*, for example, when the rotation of the medicine receiving plate part 71 is stopped, the medicines P overlapped up-and-down while contacting the lateral wall face may move inertially from the joint position between the edge parts as a start point with receiving force toward the centripetal side rather than the rotational direction of the medicine receiving plate part 71 such that the simple movement to the rotational direction as (B) in the same figure is hardly caused and then the overlap of the medicine P becomes easily cancelled. While in the cancellation of the overlap of the medicine P, the angle formed by the joint position between the edge part is particularly preferred to be 120 degrees, the angle of the joint position between the edge part may be not less than 90 degrees and less than 180 degrees.

The formation of the plurality of the edge parts of the lateral wall face may not be limited for form linearly. A lower end of the edge parts of the lateral wall face may be formed as an arc like shape. For example, it is contemplated that a convex side of the arc like shape is positioned at a side of the rotational axis 71*a*. In addition, the lower end of the edge parts of the lateral wall face may be formed as a saw blade like shape. Of course, considering the case that the shape of the lower end of the bottomless opening part 71*b* is formed to be the same with the shape of the upper end of the medicine wrapping hopper 73, an extent of a curvature of the convex in the arc like shape may be to a small.

When the number of medicines counted by the medicine number check part 6 (third camera device 61, counting processing part 82) is different from the number to be present and the medicine receiving plate part is made to rotate again normally and reversely in the high speed, the fears that the counting may erroneously done without cancelling the overlap of the medicines may be reduced. Here, in this multiple normal and reverse rotation, the control may be performed as follows for example:

rotating reversely and slightly the medicine receiving plate part 71 (pushing out the medicines in an accelerated state):

next rotating thereof reversely in a high speed (making the medicine at the lower side pop out quickly);

next rotating thereof normally in a high speed (making the medicine at the lower side pop out quickly);

next rotating thereof slightly and reversely (setting to a lower speed than that in the normal rotation so as not to dash off the medicine and to further demolish the demolished medicines).

When the medicine receiving plate part 72 comprises the light passing part 72*a* and also the medicine number check part 6 comprises the third camera device (photographing part for counting) having the lighting part 61*b*, the shaded images of the medicines may be photographed precisely.

When the third camera device (photographing part for counting) 61 comprises the reflection member 61*c*, the height of the third camera device 61 above the medicine receiving plate part 71 becomes low. Using the lens with an imaging angle as narrow as possible providing a sufficient long light path and photographing the bottomless opening part 71*b* in the imaging angle as wide as possible, the shaded images of the medicines may be photographed precisely. Here, when the lens with the wide imaging angle is used, it becomes hard to obtain proper images because of imaging of the wall face of the bottomless opening part 71*b* and also permitting the presence of the other medicine hidden by the adjacent medicine since the photographing region is photographed slantingly and the like.

Also, when the reflection face of the reflection member 61*a* is positioned to be not more than 45 degrees in the elevation angle, the height of the third camera above the medicine receiving plate member 71 may be further lowered. Here, it is possible to adopt a curved reflection face as the reflection face of the reflection member 61*c*.

When the shape of the lower end of the bottomless opening part 71*b* in the medicine receiving plate part 71 is the same with the shape of the upper end part of the medicine wrapping hopper 73, loss of the medicine becomes harder upon making the medicine fall into the medicine wrapping hopper 73 from the bottomless opening part 71*b* and also, for example, partial blocking of the lighting light for projecting the medicine wrapping hopper 73 between the bottomless opening part 71*b* and the medicine wrapping hopper 73 may be decreased.

It may be allowed to dispose the fifth camera device 63 (seal photographing part) for photographing the wrapping seal part in the medicine wrapping part 45 from the upper side of the medicine wrapping hopper 73. Thereby, the fact that the medicine was not wrapped adequately is judged from the image so that the possibility that the medicine supplied from the medicine containing/dispensing unit 11 is not actually wrapped may be determined.

Now, when the identification check of the stamp and/or the print of the medicine is performed using each of the medicine rotation part 52 in the medicine identification part 50, even if the number of medicines for one dose package is to be plural, the identification check is performed by throwing down every one medicine to each of the medicine rotation part 52. Furthermore, in this case, every one medicine is also thrown down to each of the bottomless opening part 71*b* from the medicine rotation part 52. When the bottomless opening part 71*b* is moved to locate the bottomless opening part 71*b* above the wrapping opening 72*b*, one medicine in the bottomless opening 71*b* is thrown into the wrapping paper from the medicine wrapping hopper 73.

Such processings will be performed for the number of medicines for one dose package. Then, at the lower end side of the medicine wrapping hopper 73, an optical sensor device is disposed for detecting passage of an object, and by this optical sensor the passage of one medicine from the medicine wrapping hopper 73 to the wrapping paper may be detected (counted). Therefore, by this detection (counting) it is ensured that the medicine for one dose package is normally wrapped. In the execution mode for the identification check, the medicine demolishing processing or the imaging processing by the medicine number check part 6 is not necessary. On the other hand, it may be allowed to implement not only the simple switching between the execution mode and the non-execution mode of the identification check but also an automatic switching with respect to a development. For example, in the medicine wrapping processing for plural times to one patient, the controller 8 executes the identification check of the stamp and/or the print of the medicine by the medicine identification part 50 in a stage to be the first wrapping for the plural times (for example, each of the first wrapping for the morning, noon, and evening prescriptions) and with respect to the wrapping for the repeated identical prescriptions, the controller 8 does not execute the identification check (rotation motion of each of the medicine rotation part 52 or counting of the optical sensor device and the like as well as medicine throwing for every one piece) is not performed but execute the medicine throwing processing of plural numbers for one dose package to each of the bottomless opening part 71*b*, the demolishing processing by the medicine number check part 6 and the imaging processing by the third camera device 61.

If the kind of medicines is determined to be valid based on the stamp and/or the print at the stage to be the first wrapping for each prescription, it is inferred that the wrapping to the same proscription repeated thereafter will be done properly and as described above, by omitting the identification check motion with respect to the wrapping for the repeated identical prescriptions, it is contemplated that the wrapping processing may be speed up.

Here, if measurement of the medicine number for plural times by the medicine number check part 6 is not performed and it is intended to count the plural medicines falling down simultaneously by the optical sensor device, there is a fear for happening of a counting error under the case that two medicines are positioned on the light path in the same time.

Furthermore, in the above embodiment, the medicine number check part 6 is disposed at a just upstream side near the medicine wrapping hopper 73; however, if some path is present between the position for counting the number of medicines (not limited to the structure of the medicine number check part 6) and the medicine wrapping hopper 73, it is contemplated that the adhesion of the medicine may be determined also on this path. Similarly, if some member is present between the medicine wrapping hopper 73 and the heater rollers 45*d*, 45*e*, it is contemplated that the adhesion of the medicine may be determined by the adhesion onto the member.

Described so far, the embodiments of the present invention have been described with referring to drawings; however, the present invention is not limited to ones illustrated in the drawings. To the embodiments illustrated in the drawings, within the same scope as the present invention or within the equivalent scope, various modifications or alternations may be made.

DESCRIPTION OF SIGNS

1 medicine dispensing apparatus
3 ink ribbon cassette
4 wrapping unit
5 medicine check part
6 medicine number check part
7 rotation plate
8 controller
11 medicine containing/dispensing unit
12 hopper
13 hand distribution part
45 medicine wrapping part
45*d* heater roller
45*e* heater roller
50 medicine identification part
51 turn table
52*a* lens
53 introduction part
54 hand distribution medicine introduction part
55 first camera device
56 second camera device
60 substrate
61 third camera device (photographing part for counting)
61*a* imaging element
61*b* lighting part
61*c* lens
62 fourth camera device (hopper photographing part)
62*a* lighting part
62*b* photographing part
63 fifth camera device (seal part photographing part)
63*a* lighting part
63*b* photographing part
64 hopper
65 lens
71 medicine receiving plate part
71*a* rotation axis
71*b* bottomless opening part
71*c* gear part
72 medicine receiving bottom part
72*a* light passing part
72*b* wrapping opening part
73 medicine wrapping hopper (introduction member)
74 driving part
74*a* driving gear
74*b* belt
74*c* motor
80 storage part
81 image generation part
82 counting processing part
83 adhesion determination part
84 timing generation part
85 driving control part
200 dispensing paper roll
P medicine
R ink ribbon
S dispensing paper

The invention claimed is:

1. A medicine dispensing apparatus comprising:

a medicine supply part for supplying medicines of various kinds;

a medicine wrapping part for wrapping medicine supplied from the medicine supply part for every one dose package with a dispensing paper;

an introduction member for introducing the medicine for each one dose package into the dispensing paper in the medicine wrapping part; and a medicine check part for determining based on a photographed image of the introduction member whether or not the medicine is adhered to the introduction member.

2. The medicine dispensing apparatus of claim 1, wherein the medicine check part comprises:

an introduction member photographing part for photographing the introduction member; and a determination part for determining whether or not the medicine is adhered to the introduction member based on comparison between an image photographed by the introduction member photographing part and a basic image photographed under a condition in which the medicine is not adhered to the introduction member.

3. The medicine dispensing apparatus of claim 1, wherein the medicine check part comprises a medicine number check part used for counting a number of medicines for each one dose package at an upstream side of the introduction member.

4. The medicine dispensing apparatus of claim 3, wherein the medicine number check part receives the medicine for each one dose package and photographs the medicine before the medicine is introduced into the dispensing paper in the medicine wrapping part by the introduction member.

5. The medicine dispensing apparatus of claim 3, wherein the medicine number check part comprises:

a medicine receiving plate part having a plurality of bottomless openings around a rotation axis of the medicine receiving plate part, a medicine receiving bottom part functioning as a bottom of the bottomless openings and having a wrapping opening for supplying the medicine in each bottomless opening into the introduction member at a particular position that each bottomless opening reaches during rotation of the medicine receiving plate part, wherein each bottomless opening is supplied with the medicine from the medicine supply part.

6. The medicine dispensing apparatus of claim 5, wherein alignment of each bottomless opening with the wrapping opening is cancelled by rotating the medicine receiving plate part normally or reversely.

7. The medicine dispensing apparatus of claim 6, wherein a lateral face of each bottomless opening is inclined relative to the rotation axis of the medicine receiving plate part.

8. The medicine dispensing apparatus of claim 6, wherein each bottomless opening has a plurality of edges, and wherein two of the edges farthest from the rotation axis have an angle between them.

9. The medicine dispensing apparatus of claim 8, wherein a joint between the two edges is positioned farthest from the rotation axis.

10. The medicine dispensing apparatus of claim 6, wherein the medicine receiving plate part is made to rotate normally or reversely if a number of medicines counted by using the medicine number check part is different from a predetermined number of medicines.

11. The medicine dispensing apparatus of claim 5, wherein the medicine receiving bottom part has a light passing part at a second particular position that each bottomless opening reaches during rotation of the medicine receiving plate part, and the medicine number check part further comprises: a lighting part for projecting light to the light passing part from a lower side of the light passing part, and a photographing part that guides the light projected from the lighting part and passed to an upper side through the light passing part toward an imaging element.

12. The medicine dispensing apparatus of claim 11, wherein the photographing part comprises a reflection member positioned such that a reflection face of the reflection member is inclined at a position above the light passing part, and the imaging element is positioned to receive the light reflected by the reflection face of the reflection member and propagated in a direction parallel to an upper face of the medicine receiving plate part at a position outside the medicine receiving plate part.

13. The medicine dispensing apparatus of claim 12, wherein the reflection member is positioned such that an elevation angle of the reflection face is at most 45 degrees.

14. The medicine dispensing apparatus of claim 5, wherein a shape of a lower end of each bottomless opening is the same as a shape of an upper end of the introduction member.

15. The medicine dispensing apparatus of claim 1, wherein the medicine check part comprises a seal photographing part for photographing a wrapping seal part in the medicine wrapping part from an upper side of the introduction member.

* * * * *